US006354831B1

(12) United States Patent
Wilk, Jr. et al.

(10) Patent No.: US 6,354,831 B1
(45) Date of Patent: Mar. 12, 2002

(54) POROUS GAS BURNER

(75) Inventors: Richard F. Wilk, Jr., Lisbon; Richard M. Ludwig, Columbiana; Suhas N. Patil, Alliance, all of OH (US)

(73) Assignee: R & R Holdings, Inc., Columbiana, OH (US)

( * ) Notice: Subject to any disclaimer, the term of this patent is extended or adjusted under 35 U.S.C. 154(b) by 0 days.

(21) Appl. No.: 09/062,812

(22) Filed: Apr. 20, 1998

(51) Int. Cl.[7] ..... F23D 14/12
(52) U.S. Cl. ..... 431/328; 431/125; 126/512
(58) Field of Search ..... 126/92 R, 512, 126/92 AC, 92 A, 92 B; 431/125, 326, 328

(56) References Cited

U.S. PATENT DOCUMENTS

| | | | | | |
|---|---|---|---|---|---|
| 697,941 | A | * | 4/1902 | Hewitt | 431/125 |
| 852,679 | A | * | 5/1907 | Richards | 431/125 |
| 948,561 | A | * | 2/1910 | Hansen | 431/125 |
| 1,286,108 | A | * | 11/1918 | Richards | 431/125 |
| 3,181,590 | A | * | 5/1965 | Dupler | 431/125 |
| 3,377,229 | A | * | 4/1968 | Bryan | 126/512 |
| 3,689,611 | A | | 9/1972 | Peterson | 264/43 |
| 3,696,801 | A | | 10/1972 | Whitehead | 126/92 R |
| 3,723,046 | A | | 3/1973 | Poling et al. | 431/18 |
| 3,747,585 | A | | 7/1973 | Coats | 126/92 R |
| 3,760,790 | A | | 9/1973 | Voges et al. | 126/92 R |
| 3,817,686 | A | | 6/1974 | Quittner | 431/125 |
| 3,869,335 | A | | 3/1975 | Siefert | 161/143 |
| 3,871,355 | A | | 3/1975 | Henry | 126/127 |
| 3,929,630 | A | | 12/1975 | Smith | 210/17 |
| 3,947,229 | A | | 3/1976 | Richter | 431/125 |
| 3,993,430 | A | | 11/1976 | Forker | 431/125 |
| 4,060,396 | A | | 11/1977 | Burton | 44/14 |
| 4,061,133 | A | | 12/1977 | Swain | 126/350 R |
| 4,224,053 | A | | 9/1980 | Walker | 71/118 |
| 4,262,608 | A | | 4/1981 | Jackson | 110/162 |
| 4,306,537 | A | | 12/1981 | Mitchell | 126/92 AC |
| 4,363,313 | A | | 12/1982 | Smith | 126/9 R |
| 4,475,892 | A | | 10/1984 | Faunce | 433/212 |
| 4,502,463 | A | | 3/1985 | Gregory | 126/121 |
| 4,507,355 | A | | 3/1985 | George et al. | 428/246 |
| 4,544,347 | A | | 10/1985 | Herbert | 431/125 |
| 4,573,905 | A | | 3/1986 | Meyers | 431/125 |
| 4,582,478 | A | | 4/1986 | Hilker | 431/125 |
| 4,637,372 | A | | 1/1987 | Mogol et al. | 126/127 |
| 4,651,708 | A | | 3/1987 | Groeneweg | 126/30 |
| 4,664,620 | A | | 5/1987 | Kendall et al. | 431/328 |
| 4,746,287 | A | * | 5/1988 | Lannutti | 431/328 |
| 4,762,525 | A | | 8/1988 | Wood | 44/534 |
| 4,869,664 | A | * | 9/1989 | Wright et al. | 431/125 |
| 4,875,464 | A | | 10/1989 | Shimek et al. | 126/92 R |
| 4,878,947 | A | | 11/1989 | Helferich | 106/75 |
| 4,930,490 | A | | 6/1990 | Allan | 126/92 R |
| 4,940,407 | A | | 7/1990 | Rehberg et al. | 431/126 |
| 4,963,515 | A | | 10/1990 | Helferich | 501/84 |

(List continued on next page.)

FOREIGN PATENT DOCUMENTS

EP 0194157 * 10/1986

*Primary Examiner*—Sara Clarke
(74) *Attorney, Agent, or Firm*—Sand & Sebolt

(57) ABSTRACT

A burner pad for use in a gas burner in a gas fireplace includes a plurality of noncombustible fibers held together by fillers and binders to form a noncombustible body having an interior surface and an exterior surface. The body has a porosity that allows gas to pass therethrough in a substantially random manner. The body is also dimensionally stable. The burner pad may be used to form a gas burner having a burner pan having an open top with the porous burner pad enclosing the burner pan by covering said open top of said burner pan to define a gas distribution chamber between said pad and said burner pan. Gas is supplied to the gas distribution chamber and allowed to randomly seep through the pad where it may be ignited to form a low-profile, rolling flame that simulates the appearance of glowing embers in a wood-fueled fire.

15 Claims, 2 Drawing Sheets

U.S. PATENT DOCUMENTS

| | | | | | |
|---|---|---|---|---|---|
| 4,976,253 | A | | 12/1990 | Beal et al. | 126/512 |
| 4,994,091 | A | | 2/1991 | Dougherty et al. | 44/532 |
| 5,000,162 | A | | 3/1991 | Shimek et al. | 126/512 |
| 5,030,611 | A | | 7/1991 | Ogawa et al. | 502/439 |
| 5,032,549 | A | | 7/1991 | Lang et al. | 501/84 |
| 5,092,313 | A | | 3/1992 | Blackburn et al. | 126/512 |
| 5,139,011 | A | | 8/1992 | Moon | 126/512 |
| 5,195,843 | A | | 3/1993 | George et al. | 405/63 |
| 5,205,991 | A | | 4/1993 | Avery et al. | 422/129 |
| 5,235,667 | A | * | 8/1993 | Canfield et al. | 431/328 |
| 5,243,965 | A | | 9/1993 | Maitland et al. | 126/512 |
| 5,261,389 | A | | 11/1993 | Trieb | 126/85 B |
| 5,281,399 | A | | 1/1994 | Rittler | 422/179 |
| 5,287,844 | A | | 2/1994 | Fieber | 126/30 |
| 5,360,490 | A | * | 11/1994 | Nelson | 431/328 |
| 5,390,658 | A | | 2/1995 | Prock | 126/25 R |
| 5,403,519 | A | | 4/1995 | Rittler | 252/582 |
| 5,418,195 | A | | 5/1995 | Kostuch et al. | 501/80 |
| 5,423,310 | A | | 6/1995 | Hudson et al. | 126/512 |
| 5,429,495 | A | | 7/1995 | Shimek et al. | 431/126 |
| 5,435,295 | A | | 7/1995 | Gerrard | 126/541 |
| 5,449,533 | A | | 9/1995 | Morizane | 427/344 |
| 5,452,709 | A | | 9/1995 | Mealer | 126/512 |
| 5,485,830 | A | | 1/1996 | Binzer | 126/512 |
| 5,488,016 | A | | 1/1996 | Rittler | 501/39 |
| 5,571,008 | A | | 11/1996 | Richardson et al. | 431/125 |
| 5,575,274 | A | | 11/1996 | DePalma | 126/512 |
| 5,584,680 | A | | 12/1996 | Kim | 431/125 |
| 5,601,073 | A | | 2/1997 | Shimek | 126/512 |
| 5,603,312 | A | | 2/1997 | Champion et al. | 126/77 |
| 5,617,841 | A | | 4/1997 | Whitfield et al. | 126/152 B |
| 5,645,409 | A | | 7/1997 | Ni et al. | 431/8 |
| 5,645,781 | A | | 7/1997 | Popovic' et al. | 264/639 |
| 5,647,342 | A | | 7/1997 | Jamieson et al. | 126/512 |
| 5,655,513 | A | | 8/1997 | Whitfield | 126/512 |
| 5,660,162 | A | | 8/1997 | Eavenson et al. | 126/512 |
| 5,688,568 | A | * | 11/1997 | Wolf et al. | 431/125 |
| 5,782,629 | A | * | 7/1998 | Lannutti | 431/326 |
| 5,918,592 | A | * | 7/1999 | Kazubski et al. | 126/512 |

* cited by examiner

POROUS GAS BURNER

BACKGROUND OF THE INVENTION

1. Technical Field

This invention is generally directed to gas burners and more particularly to a gas burner that simulates the appearance of the glowing embers found in a wood-fueled fire. Specifically, the present invention relates to a burner pad for a gas fireplace burner that is fabricated from a noncombustible porous material that allows gas to seep through the pad where it is ignited to form a low profile flame over substantially the entire surface area of the pad to simulate the appearance of the glowing embers of a wood-fueled fire.

2. Description of the Prior Art

The warm glowing look of a wood-fueled fire is highly desired by people who purchase fireplaces. A majority of people only desire the appearance of a wood-fueled fire without the hassle of finding and preparing fuel, disposing of the ashes, lighting the fires, and maintaining the chimney. The appearance of the glowing embers under a wood-fueled fire is one of the primary reasons a wood-fueled fire is more desirable than a clean-fuel burning fire such as the fire created in a natural gas fireplace. Glowing embers are not created in a natural gas fireplace because no solid fuel is being combusted to create embers. The natural gas fireplace is thus much cleaner than a wood-fueled fireplace but lacks the desired visual effect of the glowing embers. The glowing embers give the fire a warm appearance by lighting up the bottom of the fireplace with a rolling, glowing flame. It is thus desired in the art to provide a clean-fuel fire that simulates the appearance of the glowing embers of a wood-fueled fireplace to provide a pleasing visual appearance to the fireplace.

One type of gas log burner assembly presently in use today with gas-fueled fireplaces consists of an open-top burner pan which is filled with a loose porous material such as sand, vermiculite, ceramic particles or the like. A perforated gas supply pipe is disposed in the pan and is covered by the loose material. In these prior art burner pans, the gas is discharged from the supply pipe and filters in a random fashion through the porous medium to a combustion area above the medium. Gas logs may be supported by a grate in the combustion area to provide the appearance of burning wood logs.

Such burner assemblies must be carefully installed by a person who knows how to arrange the burner and the loose material to provide a desirable appearance to the fireplace. If the loose material or burner is improperly installed, the gas to be burned is not properly delivered to the gas logs and the appearance of the fireplace is degraded. The homeowner can easily alter the appearance of the fireplace during cleaning by disturbing the loose particles that fill the burner box. It is thus desired in the art to provide a gas burner pan that evenly distributes the gas to be burned to the gas logs without the use of a loose material.

Another gas burner known in the art is disclosed in U.S. Pat. No. 5,423,310. The gas burner disclosed in the patent produces a glowing effect by providing a cover wall over the typical open top of a burner pan. A gas supply pipe is buried within a non-combustible porous medium, such as sand, within a gas distribution chamber formed by the wall of the burner pan. The cover wall has a series of gas outlet holes arranged across the plate and an elongated slot at the upper rear edge of the cover wall. An artificial log is mounted on the top and rear of the burner pan and extends along the elongated slot and has a rough textured concave front surface. The slot and the holes in the top cover wall and the concave surface of the artificial log control and direct the flow of gas from the supply pipe into a combustion area formed in front of the artificial log to provide controlled combustion of the gas within and adjacent to the concave front surface of the log to provide a glowing effect to the rough textured surface of the artificial log.

Another gas burner is disclosed in U.S. Pat. No. 5,601,073. The burner disclosed in this patent employs a predetermined pattern of gas ports which direct the gas and thus the flames into desired locations. A layer of porous ceramic material which is impregnated with metallic salts may be used with the burner plate to produce lengthening and coloring of the gas flames of the gas burner. The patent further discloses that a rocking or sliding support of the flat gas burner imparts movements and or different length to the colored flames.

Although these prior art devices are suitable for their intended purposes, there remains room for improvement in the art for a gas burner that simulates the appearance of the glowing embers of a wood-fueled fire.

SUMMARY OF THE INVENTION

A primary objective of the present invention is to provide a gas burner that simulates the glowing embers of a wood-fueled fireplace.

Another objective of the present invention is to provide a gas burner having a burner pad that may be formed into a wide variety of different shapes but is dimensionally stable once formed.

Yet another objective of the present invention is to provide a gas burner having a porous burner pad as it upper surface such that the burner may be positioned beneath gas logs to provide the glowing ember effect.

Still another objective of the present invention is to provide a gas log having a sidewall formed from the burner pad that allows gas to seep through the entire sidewall such that the gas may burn over substantially the entire surface of the log.

A further objective of the present invention is to provide a burner pad that has an outer surface that is textured to simulate the appearance of embers.

Yet a further objective of the present invention is to provide a burner pad having gas ports that allow gas to be directed to selected areas to create large flames at those areas.

Still a further objective of the present invention is to provide a burner pad that resembles glowing embers without creating a dangerous level of carbon monoxide from the burning process.

Another objective of the present invention is to provide a burner pad that is of simple construction, which achieves the stated objectives in a simple, effective and inexpensive manner, which solves the problems, and which satisfies the needs existing in the art.

These and other objectives of the invention are achieved by a gas burner including a burner pan having an open top; and a porous burner pad having an interior surface and an exterior surface enclosing the burner pan by covering the open top of the burner pan to define a gas distribution chamber between the pad and the burner pan, the pad having substantially stable dimensions; the pad adapted to allow gas to seep through the pad from the gas distribution chamber to the exterior surface where it may be ignited.

BRIEF DESCRIPTION OF THE DRAWINGS

The preferred embodiments of the invention, illustrative of the best modes in which applicant has contemplated applying the principles of the invention, are set forth in the following description and are shown in the drawings and are particularly and distinctly pointed out and set forth in the appended claims.

Similar numbers refer to similar parts throughout the specification.

DETAILED DESCRIPTION OF THE PREFERRED EMBODIMENTS

Figure 6:
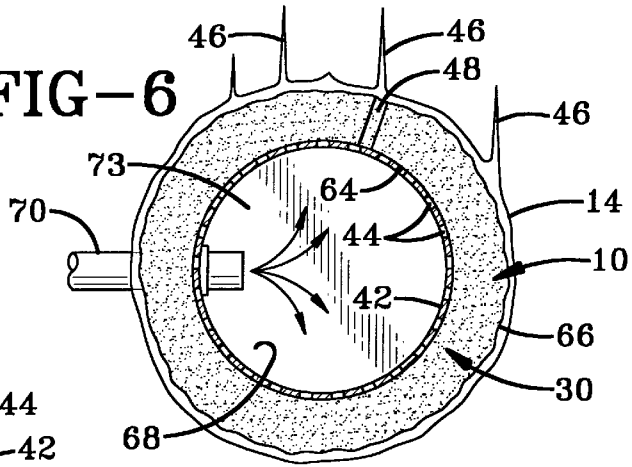
FIG. 6 is a sectional view taken substantially along line 6—6 of FIG. 5.

A burner pad for use in a gas burner in a gas fireplace according to the present invention is depicted in the drawings and is indicated generally by the numeral 10. Pad 10 is fabricated from a noncombustible porous material that has substantially stable dimensions. Pad 10 may thus be formed in various shapes and configurations to fit different hearth-related applications. Burner pad 10 defines the surface of a gas burner through which the gas to be burned passes and on which the gas is ignited.

Pad 10 may be preferably fabricated by a plurality of noncombustible fibers that are held together by fillers and binders. The fibers are preferably made from a ceramic material that are held together by fillers and binders that are generally known to those skilled in the art. Alternate materials that may be used to form pad 10 are any one of hollow alumina silica or magnesia spheres, ceramic powder, mineral wool, or glass fibers. One type of binder that may be used is a combination of colloidal silica and cationic starch mixed with water. The amounts and concentrations of the fibers and the binders may be varied to control the porosity of pad 10. The manufacturing process may also be varied to control the porosity of pad 10.

The porosity of pad 10 is controlled to allow a gaseous fluid such as combustible natural gas to seep through pad 10 when subjected to a relatively low pressure differential. This porosity allows gas to pass through substantially all of pad 10 without being forced through by a high pressure source. The porosity is controlled such that ports or other openings through pad 10 are not required to vent the gas through pad 10. Pad 10 may thus be used to randomly deliver gas to a combustion area immediately adjacent the outer surface of pad 10. The gas that seeps through pad 10 is immediately ignited in combustion area to create a constantly-changing, low profile flame 14 on pad 10. Flame 14 rolls and moves over pad 10 because the gas being burnt to form flame 14 is randomly seeping through pad 10 and exits in different concentrations in different areas. The low profile of flame 14 and its random movement allows pad 10 and flame 14 to simulate the glowing embers in the bottom of a wood-fueled fire.

Figure 5:
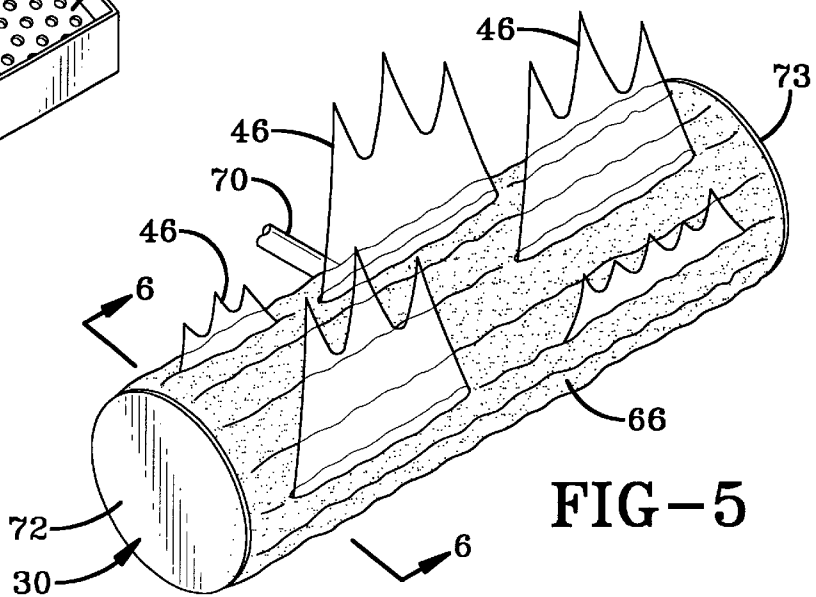
FIG. 5 is a perspective view of another alternative embodiment of a gas burner in the shape of a fire log.
Figure 1:
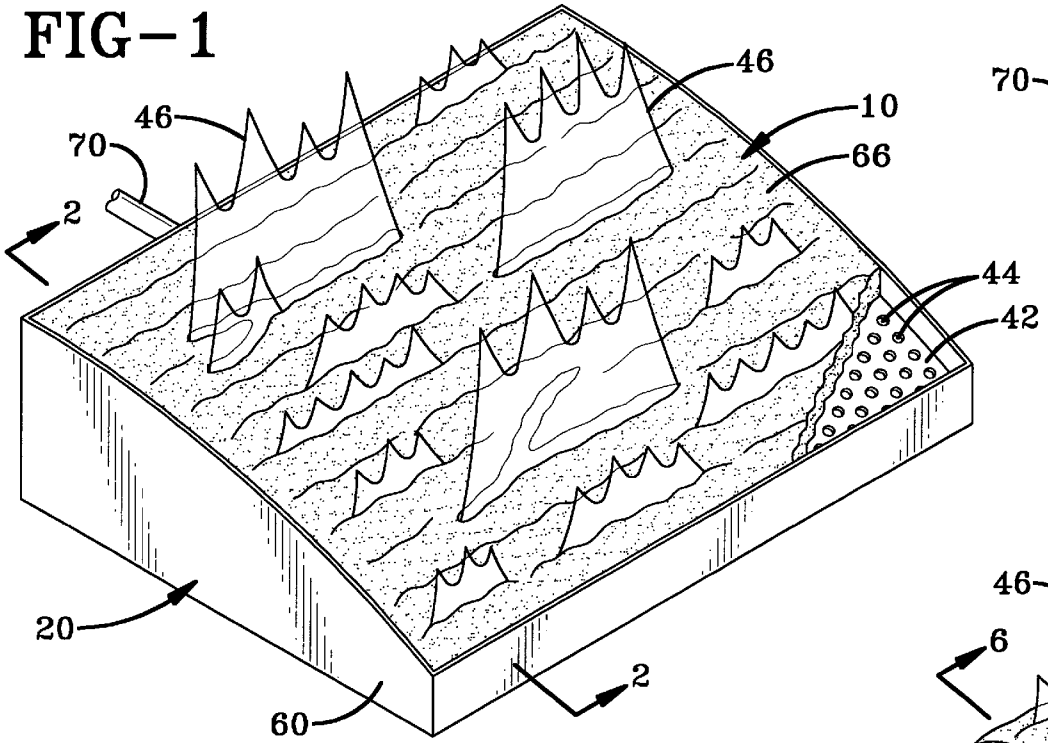
FIG. 1 is a perspective view of a gas burner utilizing a porous burner pad with a portion of the burner pad broken away.
Figure 3:
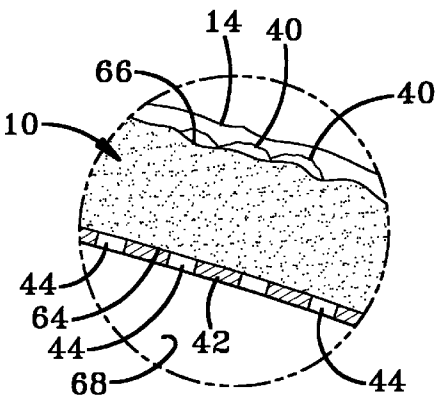
FIG. 3 is an enlarged view of an encircled portion of FIG. 2.
Figure 2:
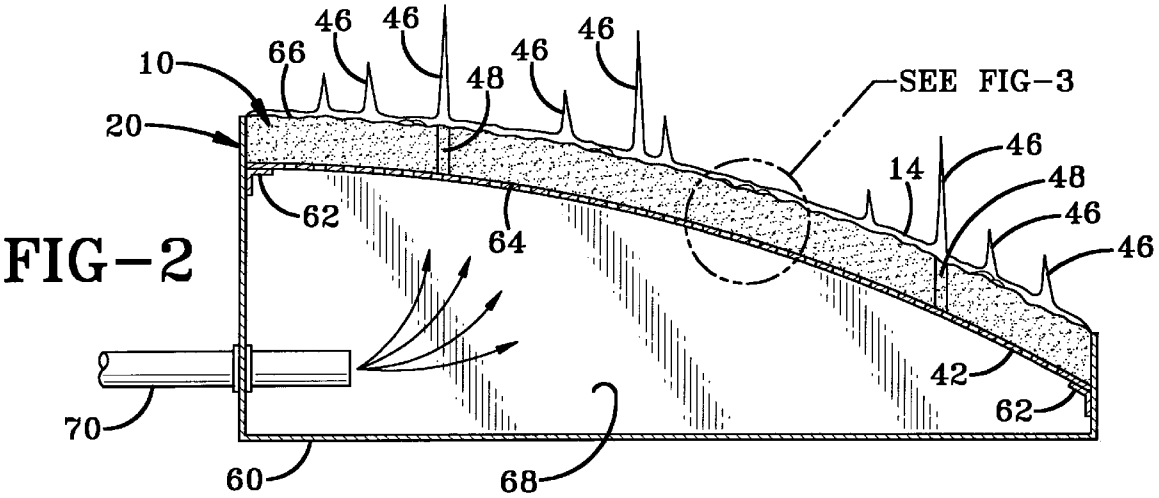
FIG. 2 is a sectional view taken substantially along line 2—2 of FIG. 1.

Pad 10 is substantially dimensionally stable unlike the loose porous material (sand or vermiculite or ceramic particles) that is used in some prior art burners. Pad 10 thus cannot be easily disturbed during the cleaning of the fireplace and is relatively easy to install. The dimensional stability of pad 10 allows it to be formed into a wide variety of shapes for various hearth-related applications. For instance, pad 10 may be used in a wide, relatively flat gas burner 20 as depicted in FIG. 1 or may be formed into a simulated wood log 30 as depicted in FIG. 5. Burner 20 may be formed in a wide variety of shapes and sizes such as generally concave or generally convex. The principles of the present invention do not depend on the shape of burner pad 10.

The fibrous material from which pad 10 is fabricated allows the manufacturer to treat the outer surface of pad 10 to simulate the look of embers or the bark on wood logs. Pad 10 may be formed with a rough, nonuniform outer surface. The outer surface may also be picked to cause various random fibers 40 of pad 10 to extend away from the outer surface of pad 10. Extending fibers 40 give pad 10 a rough appearance that simulates tree bark and provides an aesthetically desirable appearance to pad 10. Extending fibers 40 may also glow when the gas seeping through pad 10 is ignited to help give pad 10 the desired appearance of glowing embers.

Pad 10 may be formed in combination with a substantially rigid support wall 42. Although pad 10 is dimensionally stable and is capable of supporting its own weight, support wall 42 provides enough support to pad 10 to withstand significant forces that would otherwise damage pad 10. Pad 10 may be fabricated to be substantially permanently attached to support wall 42 such that pad 10 may not be removed from support wall 42 without damaging pad 10. Rigid support wall 42 may be preferably fabricated from a noncombustible material such as a metal. Other noncombustible materials may also be used such as ceramics. Support wall 42 must be porous to allow gas to flow freely through support wall 42. In one embodiment of the present invention, wall 42 is perforated with a plurality of holes 44 to allow gas to pass through wall 42. In other embodiments of the invention, wall 42 may be formed from a screen or may have a plurality of substantially parallel slots. In some applications, various areas of wall 42 may be masked to prevent gas from entering pad 10 at the masked areas. Such masking allows the manufacturer to control the location, intensity, and appearance of flame 14. Pad 10 may also be adjacent to but not permanently connected to support wall 42. In these applications, pad 10 may be lifted from wall 42 without damaging pad 10. This configuration allows the body of burner 20 to be constructed without pad 10. Pad 10 may also be sold as a component part for other burners.

In some applications of pad 10, it may be desirable to create spikes of flame 46 that extend higher than flame 14. These flame spikes 46 are created by providing gas ports 48 in pad 10 that allow an increased concentration of gas to pass through pad 10. Gas ports 48 allow gas to pass more easily and quickly through pad 10 and create flame spikes 46 when the gas escapes port 48 at the outer surface of pad 10. Gas ports 48 may be formed during fabrication of pad 10 by inserting a blank in the desired location of flame spike 46 or after fabrication of pad 10 by removing material from pad 10 in the desired location of flame spike 46.

Figure 4:
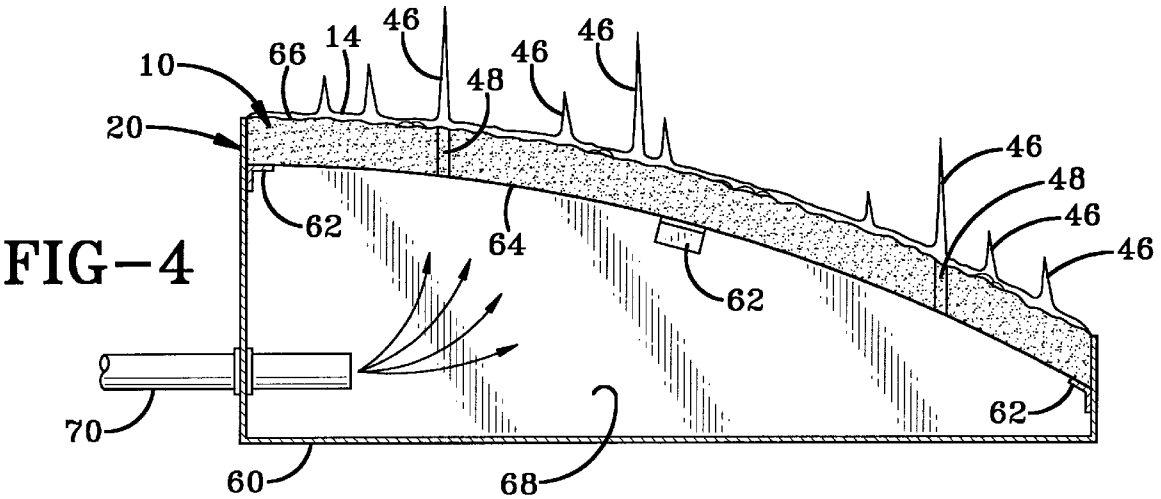
FIG. 4 is a perspective view of an alternative embodiment of the gas burner of FIG. 1.

In the embodiment of the invention depicted in FIG. 4, pad 10 is utilized without support wall 42. Pad 10 is dimensionally stable and is sufficiently rigid to support itself without collapsing. As such, pad 10 can be manufactured to desired sizes and sold as a component to entities who use pad 10 to create burners of various sizes.

Pad 10 of the present invention is used as part of a gas burner 20 in FIGS. 1 through 4. Gas burner 20 includes a burner pan 60 having an open top and pad 10 sized to substantially close the open top of burner pan 60. Pad 10 may be supported in burner pan 60 on a plurality of clips 62 or with other supports known in the art. Pad 10 may or may not include support wall 42. When support wall 42 is used, wall 42 may be welded directly to burner pan 60 or clips 62. Once supported on burner pan 60, pad 10 has an interior surface 64 and an exterior surface 66 relative to a gas distribution chamber 68. A gas line 70 passes through burner pan 60 to be in fluid communication with chamber 68. Gas is supplied to chamber 68 under enough pressure from gas line 70 to fill chamber 68 and seep through pad 10.

Gas burner 20 is used by placing it in a desired location such as below a set of fire logs. Gas line 70 is then connected to a supply of gas such that chamber 68 fills with gas. The gas then escapes from chamber 68 through porous pad 10 where it is ignited immediately adjacent exterior surface 66 to form flame 14. As described above, flame 14 provides a low profile flame over the entire exterior surface 66 of burner 20 that simulates the appearance of the glowing embers of a wood-fueled fire.

In another embodiment of the present invention, pad 10 may be used to form a gas burner in the form of a gas or fire log 30 as depicted in FIGS. 5 and 6. Gas burner 30 includes a substantially cylindrical sidewall that simulates the appearance of a wood log. The sidewall is formed from a pad 10 that may or may not include a support wall 42. Burner 30 further includes a pair of end walls 72 that cooperate with the sidewall to define a gas distribution chamber 68 within burner 30. Pad 10 has an interior surface 64 and an exterior surface 66 relative to gas distribution chamber 68. A gas line 70 passes through burner 30 to be in fluid communication with gas distribution chamber 68. Gas is supplied to the chamber under enough pressure from gas line 70 to fill chamber 68 and seep through pad 10.

Gas burner 30 is used by placing it in a desired location such as above gas burner 20 described above or in combination with other burners 30. Gas line 70 is then connected to a supply of gas such that gas distribution chamber 68 fills with gas. The gas then escapes from chamber 68 through porous pad 10 where it is ignited immediately adjacent exterior surface 66 to form flame 14. As described above, flame 14 provides a low profile flame over the entire exterior surface 66 of burner 20 that creates the appearance of a burning wood log.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the porous burner pad is construed and used, the characteristics of the construction, and the advantageous, new and useful results obtained; the new and useful structures, devices, elements, arrangements, parts and combinations, are set forth in the appended claims.

What is claimed is:

1. A gas burner comprising:

a burner pan having an open top;

a porous burner pad having an interior surface and an exterior surface enclosing said burner pan by covering said open top of said burner pan to define a gas distribution chamber between said pad and said burner pan, said pad having substantially stable dimensions; said pad being fabricated from a refractory fiber material; said pad having a porosity that allows gas to pass therethrough in a substantially random manner; said pad adapted to allow gas to seep through said pad from said gas distribution chamber to said exterior surface where it may be ignited;

at least some of the fibers of said pad extending away from said exterior surface of said pad; and a porous rigid support wall attached to said interior surface of said porous burner pad.

2. A gas burner according to claim 1 wherein said support wall is a perforated noncombustible material.

3. A gas burner according to claim 1 wherein said support wall is a noncombustible screen.

4. A gas burner according to claim 1 wherein said fibers that extend away from said exterior surface glow when subjected to burning gas.

5. A gas burner according to claim 1 wherein said pad defines at least one gas port that extends from said interior surface to said exterior surface.

6. A gas burner comprising:

a substantially cylindrically-shaped sidewall having an interior surface and an exterior surface; and first and second end walls connected to said sidewall to define a gas distribution chamber between said sidewall and said end walls;

one of said end walls and said sidewall defining an inlet to said gas distribution chamber;

at least said sidewall being formed from a non-combustible porous material that allows gas to seep through said sidewall from said gas distribution chamber to said exterior surface where it may be ignited; said non-combustible porous material being a refractory fiber material having a porosity that allows gas to pass therethrough in a substantially random manner; and at least some of the fibers of the refractory fiber material extend away from said exterior surface of said sidewall.

7. A gas burner according to claim 6 further comprising a porous rigid support wall attached to said sidewall at said interior surface of said sidewall.

8. A gas burner according to claim 6 wherein said fibers that extend away from said exterior surface glow when subjected to burning gas.

9. A gas burner according to claim 6 wherein said sidewall defines at least one gas port that extends from said interior surface to said exterior surface.

10. A burner pad for use in a gas burner in a gas fireplace, said pad comprising a plurality of noncombustible refractory fibers held together by fillers and binders to form a non-combustible refractory body having an interior surface and an exterior surface, said body having a porosity that allows gas to pass therethrough in a substantially random manner; said body being dimensionally stable; and a porous, non-combustible rigid support wall attached to said body at said interior surface of said body; and at least some of the fibers forming said body extend away from said exterior surface.

11. A burner pad according to claim 10 wherein said fibers that extend away from said exterior surface glow when subjected to burning gas.

12. A burner pad according to claim 10 wherein said fibers are ceramic fibers.

13. A burner pad according to claim 10 wherein said fibers are mineral wool.

14. A burner pad according to claim 10 wherein said fibers are rock wool.

15. A burner pad according to claim 10 wherein said body defines at least one gas port that extends from said interior surface to said exterior surface.

* * * * *